US012599161B2

(12) United States Patent
Abi Aoun et al.

(10) Patent No.: US 12,599,161 B2
(45) Date of Patent: Apr. 14, 2026

(54) METHOD OF MAKING AEROSOL-FORMING SUBSTRATE

(71) Applicant: Nicoventures Trading Limited, London (GB)

(72) Inventors: Walid Abi Aoun, London (GB); Caner Yurteri, London (GB); Julian Darryn White, London (GB); Martin Daniel Horrod, London (GB)

(73) Assignee: NICOVENTURES TRADING LIMITED, London (GB)

( * ) Notice: Subject to any disclaimer, the term of this patent is extended or adjusted under 35 U.S.C. 154(b) by 459 days.

(21) Appl. No.: 17/264,254

(22) PCT Filed: Jul. 31, 2019

(86) PCT No.: PCT/EP2019/070720
§ 371 (c)(1),
(2) Date: Jan. 28, 2021

(87) PCT Pub. No.: WO2020/025722
PCT Pub. Date: Feb. 6, 2020

(65) Prior Publication Data

US 2021/0289831 A1 Sep. 23, 2021

(30) Foreign Application Priority Data

Jul. 31, 2018 (GB) ..... 1812499

(51) Int. Cl.

| | |
|---|---|
| ***A24B 15/167*** | (2020.01) |
| ***A24B 3/14*** | (2006.01) |
| ***A24B 15/14*** | (2006.01) |
| ***A24B 15/18*** | (2006.01) |
| ***A24C 5/01*** | (2020.01) |

(52) U.S. Cl.
CPC ..... *A24B 15/167* (2016.11); *A24B 3/14* (2013.01); *A24B 15/14* (2013.01); *A24B 15/186* (2013.01); *A24C 5/01* (2020.01)

(58) Field of Classification Search
CPC ..... A24B 15/167; A24B 3/14; A24B 15/14; A24B 15/186; A24C 5/01
See application file for complete search history.

(56) References Cited

U.S. PATENT DOCUMENTS

| | | | | |
|---|---|---|---|---|
| 6,397,840 | B1 | 6/2002 | Chrai et al. | |
| 2004/0129280 | A1* | 7/2004 | Woodson | A24D 1/20 131/194 |
| 2006/0264130 | A1* | 11/2006 | Karles | D01F 9/04 442/96 |
| 2009/0038628 | A1* | 2/2009 | Shen | D01D 5/0038 131/274 |
| 2015/0096572 | A1* | 4/2015 | Hubinette | A24B 15/16 131/117 |
| 2015/0209530 | A1* | 7/2015 | White | A24D 1/20 128/200.23 |
| 2017/0340003 | A1* | 11/2017 | Batista | A24F 40/46 |

FOREIGN PATENT DOCUMENTS

| | | | |
|---|---|---|---|
| JP | 2006511259 | A | 4/2006 |
| KR | 20180058714 | A | 6/2018 |
| RU | 2576582 | C2 | 3/2016 |
| WO | 2016005533 | A1 | 1/2016 |
| WO | 2017108912 | A1 | 6/2017 |

OTHER PUBLICATIONS

"International Preliminary Report on Patentability received for PCT Patent Application No. PCT/EP2019/070720, mailed on Feb. 11, 2021.", 7 pages.
"International Search Report and Written Opinion received for PCT Patent Application No. PCT/EP2019/070720, mailed on Nov. 27, 2019", 9 Pages.

* cited by examiner

*Primary Examiner* — Michael H. Wilson
*Assistant Examiner* — Jennifer A Kessie
(74) *Attorney, Agent, or Firm* — WOMBLE BOND DICKINSON (US) LLP

(57) ABSTRACT

Described herein is a method of making an aerosol-forming substrate. The aerosol-forming substrate comprises an aerosol-forming material which comprises nicotine and/or a tobacco material. The method comprises electrospraying the aerosol-forming material or component or precursor thereof.

14 Claims, No Drawings

METHOD OF MAKING AEROSOL-FORMING SUBSTRATE

PRIORITY CLAIM

The present application is a National Phase entry of PCT Application No. PCT/EP2019/070720, filed Jul. 31, 2019, which claims priority from Great Britain Application No. 1812499.0, filed Jul. 31, 2018, each of which is hereby fully incorporated herein by reference.

TECHNICAL FIELD

The present disclosure relates to a method of making an aerosol-forming substrate.

BACKGROUND

Smoking articles such as cigarettes, cigars and the like burn tobacco during use to create tobacco smoke. Alternatives to these types of articles release an inhalable aerosol or vapor by releasing compounds from a substrate material by heating without burning. These may be referred to as non-combustible smoking articles or aerosol generating assemblies.

One example of such a product is a heating device which release compounds by heating, but not burning, a solid aerosolizable material. This solid aerosolizable material may, in some cases, contain a tobacco material. The heating volatilises at least one component of the material, typically forming an inhalable aerosol. These products may be referred to as heat-not-burn devices, tobacco heating devices or tobacco heating products. Various different arrangements for volatilising at least one component of the solid aerosolizable material are known.

As another example, there are e-cigarette/tobacco heating product hybrid devices, also known as electronic tobacco hybrid devices. These hybrid devices contain a liquid source (which may or may not contain nicotine) which is vaporized by heating to produce an inhalable vapor or aerosol. The device additionally contains a solid aerosolizable material (which may or may not contain a tobacco material) and components of this material are entrained in the inhalable vapor or aerosol to produce the inhaled medium.

SUMMARY

The disclosure describes a method of making an aerosol-forming substrate; the aerosol-forming substrate comprising an aerosol-forming material, the aerosol-forming material comprising an active substance; the method comprising electrospraying the aerosol-forming material or component or precursor thereof.

In one embodiment the active substance comprises nicotine or a tobacco material. That is, there is provided a method of making an aerosol-forming substrate; the aerosol-forming substrate comprising an aerosol-forming material, the aerosol-forming material comprising nicotine or a tobacco material; the method comprising electrospraying the aerosol-forming material or component or precursor thereof.

The aerosol-forming substrate obtained by the method described herein may be configured for use in an assembly that heats the substrate to generate an aerosol, without burning.

The disclosure also describes an aerosol forming substrate obtained by this process, and aerosol generating articles or assemblies containing a substrate obtained by this process.

The disclosure also describes the use of such a substrate, article or assembly, in the generation of an inhalable aerosol.

DETAILED DESCRIPTION

The inventors have determined that electrospraying can be used as a process for making films of aerosol-forming materials which may be used in aerosol generating articles or assemblies.

In some cases, the substrate may comprise a carrier on which the aerosol-forming material is provided, wherein the method comprises electrospraying the aerosol-forming material or component or precursor thereof onto the carrier. Throughout this text, reference to a surface onto which materials are sprayed may reference a carrier. "Aerosol-forming material" may also conveniently be referred to as "aerosol generating material": these terms may be used interchangeably.

Electrospraying charges particles as they are sprayed. The particles from a single plume all have the same charge and consequently disperse evenly (due to the consequent electrostatic forces). In some cases, the surface onto which the particles are sprayed may be oppositely charged in order to attract the sprayed particles.

The inventors have determined that electrospraying is advantageous since a subsequent solvent removal step is not required or may be shortened. Solvent is lost during flight, at least partly due to the very high surface area of the material in droplet form. This obviation or minimisation of a solvent removal step minimises the need to heat the material, improving manufacturing efficiency. Further, heating a tobacco/nicotine-containing material during manufacture can affect the chemical composition of the material, or affect the downstream organoleptic properties of the resulting aerosol during consumption.

Electrospraying also results in a homogenous material of even thickness, due to efficient dispersal of the sprayed components.

Moreover, electrospraying offers the ability to readily generate a non-uniform film. For example, different areas of the film may comprise different flavors, or different areas may have different thicknesses (thereby providing different aerosol generation when different areas are heated). Application of the electrosprayed material in this selective manner can be achieved through modification of spray direction or the spray rate over the spraying period, for example. In another example, it can be achieved by selectively charging areas of the surface onto which the materials are sprayed so that the sprayed material adheres selectively to some areas and not others (in a manner analogous to electrographic printing). In another example, it can be achieved using a spaced array of nozzles in the electrospray apparatus, and where different nozzles may spray a different volume or composition of material.

In some cases the material that is electrosprayed is a slurry pre-cursor of the aerosol-forming material, wherein the slurry comprises all of the components of the aerosol-forming material.

In some other cases, the material that is electrosprayed may comprise some but not all components of the aerosol-forming material. For example, a first material may be coated onto the surface onto which materials are sprayed (or, may be impregnated into the carrier), and then the remaining components of the aerosol generating material may be added by electrospraying. For example, the surface may be pre-loaded with a first material and then a binding agent may be electrosprayed onto that material, causing binding (for example, causing gelation). In another case, the surface may be pre-loaded with a setting agent (e.g. a calcium source) and a gel-precursor slurry (containing all other components of the aerosol-forming material, including alginate as a binder) may be sprayed onto the surface (resulting in gelation on contact of the calcium and alginate). In some cases, the materials are sprayed onto a carrier that comprises a reconstituted tobacco, wherein the reconstituted tobacco contains calcium. In yet further cases, the surface may be preloaded with a gel-precursor slurry (containing all components of the aerosol-forming material except for the setting agent, including alginate as a binder), and then the setting agent may be sprayed onto the surface (resulting in gelation on contact of the calcium and alginate). In some instances, this may involve the spraying of a tobacco extract which contains calcium.

In some other cases, more than one material may be separately electrosprayed onto the surface, wherein the combination provides all components of the aerosol-forming material. In such cases, mixing of the components may occur in the spray plume or after contact with the surface.

For example, in one case, a first nozzle may spray a solution of a gelling agent in water and a second nozzle may spray a solution comprising a setting agent, an aerosol generating agent and nicotine or flavor.

For example, two nozzles may be used which impart opposing charges to the sprays. The spraying components will then mix in the spray plume. Moreover, the charges can be set at levels such that once mixed, the mixed droplet has negligible charge and does not interfere in subsequent electrically-driven mixing events. Mixing can then be achieved at stoichiometric limits and results in a very uniform layer of deposited material.

In some cases, the two nozzles may comprise a central nozzle and an annular nozzle which are arranged co-axially. In such an example, aerosol generating agent and the gelling agent may be sprayed from separate nozzles; for example, the outer annular nozzle may spray a solution comprising a gelling agent in water, and the inner nozzle may spray a solution comprising a setting agent, an aerosol generating agent and nicotine or flavor.

In some cases, one or more electrodes may be arranged between the electrospray nozzle and the surface in order to direct or influence the spray dispersion.

In some cases, there may be more than one electrospray nozzle. In some cases, the aperture in the or each nozzle may be sized in the range of 0.1-1.0 mm, suitably 0.5-1.0 mm. The inventors have found that the sprayed materials in this field of application may form relatively large droplets (due to the material viscosity), and a smaller nozzle size may become blocked.

In some cases, the surface onto which material is sprayed may be heated to a temperature of between 20° C. and 90° C. during spraying, suitably between about 25° C. and 60° C. In some cases, the nozzles may be heated to a temperature of between 20° C. and 90° C. during spraying, suitably between about 25° C. and 60° C.

The aerosol-forming material comprises an active substance and optionally a flavorant. For example, the aerosol-forming material may comprise nicotine, a tobacco material, a flavorant, or combinations thereof. In some cases, it may further comprise one or more of an aerosol generating agent and a gelling agent. In some cases, the aerosol-forming material may be an amorphous solid (discussed below in more detail).

In some cases, the aerosol generating material may comprise embedded heating means, such as resistive or inductive heating elements. For example, the heating means may be embedded in the amorphous solid. In some cases, the embedded heating means may be arranged on the surface onto which material is sprayed, so that they become embedded during the manufacturing process.

As used herein, the term "tobacco material" refers to any material comprising tobacco or derivatives therefore. The term "tobacco material" may include one or more of tobacco, tobacco derivatives, expanded tobacco, reconstituted tobacco or tobacco substitutes. The tobacco material may comprise one or more of ground tobacco, tobacco fibre, cut tobacco, extruded tobacco, tobacco stem, reconstituted tobacco, tobacco extract, or combinations thereof. In some cases, the tobacco may be denicotinized tobacco.

The tobacco used to produce tobacco material may be any suitable tobacco, such as single grades or blends, cut rag or whole leaf, including Virginia, Burley, Oriental, or combinations thereof. It may also be tobacco particle 'fines' or dust, expanded tobacco, stems, expanded stems, and other processed stem materials, such as cut rolled stems. The tobacco material may be a ground tobacco or a reconstituted tobacco material. The reconstituted tobacco material may comprise tobacco fibres, and may be formed by casting, a Fourdrinier-based paper making-type approach with back addition of tobacco extract, or by extrusion.

As used herein, the term "nicotine" may refer to nicotine or salts thereof. The compounds may be natural e.g., extracted from tobacco plant) or synthetic.

As used herein, the term "aerosol generating agent" refers to an agent that promotes the generation of an aerosol. An aerosol generating agent may promote the generation of an aerosol by promoting an initial vaporization, the condensation of a gas to an inhalable solid, or liquid aerosol.

Suitable aerosol generating agents include, but are not limited to: a polyol such as erythritol, sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate. The aerosol generating agent may suitably have a composition that does not dissolve menthol. The aerosol generating agent may suitably comprise, consist essentially of or consist of glycerol.

As used herein, the terms "binding agent", "gelling agent", "binder" and the like, refer to a material which aids in binding other components of the aerosol-forming material together. For example, the binding agent may be a gelling agent or may form cross-links within the aerosol-forming material to bind components together. Suitably, the binding agent may comprise one or more compounds selected from the group comprising alginates, pectins, starches (and derivatives), celluloses (and derivatives), gums, silica or silicones compounds, clays, polyvinyl alcohol and combinations thereof. For example, in some embodiments, the binding agent comprises one or more of alginates, pectins, hydroxyethyl cellulose, hydroxypropyl cellulose, carboxymethylcellulose, pullulan, xanthan gum guar gum, carrageenan, agarose, acacia gum, fumed silica, PDMS, sodium silicate, kaolin and polyvinyl alcohol. In some cases, the gelling agent comprises alginate or pectin, and may be combined with a setting agent (such as a calcium source) during formation of the amorphous solid. In some cases, the amorphous solid may comprise a calcium-crosslinked alginate or a calcium-crosslinked pectin.

In some embodiments, the gelling agent comprises alginate, and the alginate may be present in the amorphous solid in an amount of from 10-30 wt % of the amorphous solid (calculated on a dry weight basis). In some embodiments, alginate may be the only gelling agent present in the amorphous solid. In other embodiments, the gelling agent comprises alginate and at least one further gelling agent, such as pectin.

In some embodiments the amorphous solid may include gelling agent comprising carrageenan.

A binding agent may be included in the aerosol-forming material in any suitable quantity and concentration. The quantity and concentration of the binding agent included in the material may vary depending on the composition of the material and the properties desired of the device into which the aerosol-forming material is incorporated.

The active substance as used herein may be a physiologically active material, which is a material intended to achieve or enhance a physiological response. The active substance may for example be selected from nutraceuticals, nootropics, psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, cannabis or another botanical.

In some embodiments, the active substance comprises nicotine.

In some embodiments, the active substance comprises caffeine, melatonin or vitamin B12.

As noted herein, the active substance may comprise one or more constituents, derivatives or extracts of cannabis, such as one or more cannabinoids or terpenes.

Cannabinoids are a class of natural or synthetic chemical compounds which act on cannabinoid receptors (e.g., CB1 and CB2) in cells that repress neurotransmitter release in the brain. Cannabinoids may be naturally occurring (phytocannabinoids) from plants such as cannabis, from animals (endocannabinoids), or artificially manufactured (synthetic cannabinoids). Cannabis species express at least 85 different phytocannabinoids, and are divided into subclasses, including cannabigerols, cannabichromenes, cannabidiols, tetrahydrocannabinols, cannabinols and cannabinodiols, and other cannabinoids. Cannabinoids found in cannabis include, without limitation: cannabigerol (CBG), cannabichromene (CBC), cannabidiol (CBD), tetrahydrocannabinol (THC), cannabinol (CBN), cannabinodiol (CBDL), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabinerolic acid, cannabidiolic acid (CBDA), Cannabinol propyl variant (CBNV), cannabitriol (CBO), tetrahydrocannabmolic acid (THCA), and tetrahydrocannabivarinic acid (THCV A).

As noted herein, the active substance may comprise or be derived from one or more botanicals or constituents, derivatives or extracts thereof. As used herein, the term "botanical" includes any material derived from plants including, but not limited to, extracts, leaves, bark, fibres, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha arvensis, Mentha* c.v., *Mentha niliaca, Mentha piperita, Mentha piperita citrata* c.v., *Mentha piperita* c.v., *Mentha spicata crispa, Mentha cordifolia, Mentha longifolia, Mentha suaveolens variegata, Mentha pulegium, Mentha spicata* c.v. and *Mentha suaveolens.*

In some embodiments, the botanical may be selected from eucalyptus, star anise, cocoa and hemp.

In some embodiments, the botanical may be selected from rooibos and fennel.

As used herein, the terms "flavor" and "flavorant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

The flavor may suitably comprise one or more mint-flavors suitably a mint oil from any species of the genus *Mentha*. The flavor may suitably comprise, consist essentially of or consist of menthol.

In some embodiments, the flavor comprises menthol, spearmint or peppermint.

In some embodiments, the flavor comprises flavor components of cucumber, blueberry, citrus fruits or redberry.

In some embodiments, the flavor comprises eugenol.

In some embodiments, the flavor comprises flavor components extracted from tobacco.

In some embodiments, the flavor comprises flavor components extracted from cannabis.

In some embodiments, the flavor may comprise a sensate, which may be intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucalyptol, WS-3.

In some cases, the aerosol-forming material may comprise, consist essentially of or consist of a dried gel, which may also be referred to herein as an "amorphous solid", a "monolithic solid" (e.g., non-fibrous). The amorphous solid is a solid material that may retain some fluid, such as liquid, within it. In some cases, the aerosol-forming material may comprise from about 50 wt %, 60 wt % or 70 wt % of amorphous solid, to about 90 wt %, 95 wt % or 100 wt % of amorphous solid.

In some cases, the amorphous solid may have a thickness of about 0.015 mm to about 1.0 mm. Suitably, the thickness may be in the range of about 0.05 mm, 0.1 mm or 0.15 mm to about 0.5 mm or 0.3 mm. The inventors have found that a material having a thickness of 0.2 mm is particularly suitable. The amorphous solid may comprise more than one layer, and the thickness described herein refers to the aggregate thickness of those layers.

The inventors have established that if the aerosol-forming amorphous solid is too thick, then heating efficiency is compromised. This adversely affects the power consumption in use. Conversely, if the aerosol-forming amorphous solid is too thin, it is difficult to manufacture and handle; a very thin material may be fragile, compromising aerosol formation in use.

The inventors have established that the amorphous solid thicknesses stipulated herein optimise the material properties in view of these competing considerations.

The thickness stipulated herein is a mean thickness for the material. In some cases, the amorphous solid thickness may vary by no more than 25%, 20%, 15%, 10%, 5% or 1%.

In some cases, the amorphous solid may comprise 1-60 wt % of a gelling agent wherein these weights are calculated on a dry weight basis.

Suitably, the amorphous solid may comprise from about 1 wt %, 5 wt %, 10 wt %, 15 wt %, 20 wt % or 25 wt % to about 60 wt %, 50 wt %, 45 wt %, 40 wt %, 35 wt %, 30 wt % or 27 wt % of a gelling agent (all calculated on a dry weight basis). For example, the amorphous solid may comprise 1-50 wt %, 5-40 wt %, 10-30 wt % or 15-27 wt % of a gelling agent.

In some embodiments, the gelling agent comprises a hydrocolloid. In some embodiments, the gelling agent comprises one or more compounds selected from the group comprising alginates, pectins, starches (and derivatives), celluloses (and derivatives), gums, silica or silicones compounds, clays, polyvinyl alcohol and combinations thereof. For example, in some embodiments, the gelling agent comprises one or more of alginates, pectins, hydroxyethyl cellulose, hydroxypropyl cellulose, carboxymethylcellulose, pullulan, xanthan gum guar gum, carrageenan, agarose, acacia gum, fumed silica, PDMS, sodium silicate, kaolin and polyvinyl alcohol. In some cases, the gelling agent comprises a calcium-crosslinked alginate.

In some embodiments, the gelling agent comprises alginate, and the alginate may be present in the amorphous solid in an amount of from 10-30 wt % of the amorphous solid (calculated on a dry weight basis). In some embodiments, alginate may be the only gelling agent present in the amorphous solid. In other embodiments, the gelling agent comprises alginate and at least one further gelling agent, such as pectin.

Suitably, the amorphous solid may comprise from about 5 wt %, 10 wt %, 15 wt %, or 20 wt % to about 80 wt %, 70 wt %, 60 wt %, 55 wt %, 50 wt %, 45 wt % 40 wt %, or 35 wt % of an aerosol generating agent (all calculated on a dry weight basis). The aerosol generating agent may act as a plasticiser. For example, the amorphous solid may comprise 5-60 wt %, 10-50 wt % or 20-40 wt % of an aerosol generating agent. In some cases, the aerosol generating agent comprises one or more compound selected from erythritol, propylene glycol, glycerol, triacetin, sorbitol and xylitol. In some cases, the aerosol generating agent comprises, consists essentially of or consists of glycerol. The inventors have established that if the content of the plasticiser is too high, the amorphous solid may absorb water resulting in a material that does not create an appropriate consumption experience in use. The inventors have established that if the plasticiser content is too low, the amorphous solid may be brittle and easily broken. The plasticiser content specified herein provides an amorphous solid flexibility which allows the amorphous solid sheet to be wound onto a bobbin, which may be useful in manufacture of aerosol generating articles.

In some cases, the amorphous solid may comprise a flavor. Suitably, the amorphous solid may comprise up to about 60 wt %, 50 wt %, 40 wt %, 30 wt %, 20 wt %, 10 wt % or 5 wt % of a flavor. In some cases, the amorphous solid may comprise at least about 0.1 wt % 0.5 wt %, 1 wt %, 2 wt %, 5 wt % 10 wt %, 20 wt % or 30 wt % of a flavor (all calculated on a dry weight basis). For example, the amorphous solid may comprise 0.1-60 wt %, 1-60 wt %, 5-60 wt %, 10-60 wt %, 20-50 wt % or 30-40 wt % of a flavor. In some cases, the flavor (if present) comprises, consists essentially of or consists of menthol. In some cases, the amorphous solid does not comprise a flavor.

The amorphous solid comprises an active substance such as a tobacco material or nicotine. For example, the amorphous solid may additionally comprise powdered tobacco or nicotine or a tobacco extract. In some cases, the amorphous solid may comprise from about 1 wt %, 5 wt %, 10 wt %, 15 wt %, 20 wt % or 25 wt % to about 70 wt %, 60 wt %, 50 wt %, 45 wt % or 40 wt % (calculated on a dry weight basis) of active substance. In some cases, the amorphous solid may comprise from about 1 wt %, 5 wt %, 10 wt %, 15 wt %, 20 wt % or 25 wt % to about 70 wt %, 60 wt %, 50 wt %, 45 wt % or 40 wt % (calculated on a dry weight basis) of a tobacco material or nicotine.

In some cases, the amorphous solid comprises a tobacco extract. In some cases, the amorphous solid may comprise 5-60 wt % (calculated on a dry weight basis) of tobacco extract. In some cases, the amorphous solid may comprise from about 5 wt %, 10 wt %, 15 wt %, 20 wt % or 25 wt % to about 55 wt %, 50 wt %, 45 wt % or 40 wt % (calculated on a dry weight basis) tobacco extract. For example, the amorphous solid may comprise 5-60 wt %, 10-55 wt % or 25-55 wt % of tobacco extract. The tobacco extract may contain nicotine at a concentration such that the amorphous solid comprises 1 wt % 1.5 wt %, 2 wt % or 2.5 wt % to about 6 wt %, 5 wt %, 4.5 wt % or 4 wt % (calculated on a dry weight basis) of nicotine. In some cases, there may be no nicotine in the amorphous solid other than that which results from the tobacco extract.

In some embodiments the amorphous solid comprises no tobacco material but does comprise nicotine. In some such cases, the amorphous solid may comprise from about 1 wt %, 2 wt %, 3 wt % or 4 wt % to about 20 wt %, 15 wt %, 10 wt % or 5 wt % (calculated on a dry weight basis) of nicotine. For example, the amorphous solid may comprise 1-20 wt % or 2-5 wt % of nicotine.

In some cases, the total content of active substance or flavor may be at least about 0.1 wt %, 1 wt %, 5 wt %, 10 wt %, 20 wt %, 25 wt % or 30 wt %. In some cases, the total content of active substance or flavor may be less than about 80 wt %, 70 wt %, 60 wt %, 50 wt % or 40 wt % (all calculated on a dry weight basis).

In some cases, the total content of tobacco material, nicotine and flavor may be at least about 1 wt %, 5 wt %, 10 wt %, 20 wt %, 25 wt % or 30 wt %. In some cases, the total content of tobacco material, nicotine and flavor may be less than about 80 wt %, 70 wt %, 60 wt %, 50 wt % or 40 wt % (all calculated on a dry weight basis).

In some embodiments, the amorphous solid may be a hydrogel and comprises less than about 20 wt % of water calculated on a wet weight basis. In some cases, the hydrogel may comprise less than about 15 wt %, 12 wt % or 10 wt % of water calculated on a wet weight basis (WWB). In some cases, the hydrogel may comprise at least about 1 wt %, 2 wt % or at least about 5 wt % of water (WWB).

In some embodiments, the amorphous solid comprises from about 1 wt % to about 15 wt % water, or from about 5 wt % to about 15 wt % calculated on a wet weight basis. Suitably, the water content of the amorphous solid may be from about 5 wt %, 7 wt % or 9 wt % to about 15 wt %, 13 wt % or 11 wt % (WWB), most suitably about 10 wt %.

In some embodiments, the amorphous solid comprises less than 60 wt % of a filler, such as from 1 wt % to 60 wt %, or 5 wt % to 50 wt %, or 5 wt % to 30 wt %, or 10 wt % to 20 wt %.

In other embodiments, amorphous solid comprises less than 20 wt %, suitably less than 10 wt % or less than 5 wt % of a filler. In some cases, the amorphous solid comprises less than 1 wt % of a filler, and in some cases, comprises no filler.

The filler, if present may comprise one or more inorganic filler materials, such as calcium carbonate, perlite, vermiculite, diatomaceous earth, colloidal silica, magnesium oxide, magnesium sulphate, magnesium carbonate, and suitable inorganic sorbents, such as molecular sieves. The filler may comprise one or more organic filler materials such as wood pulp, cellulose and cellulose derivatives. In particular cases, the amorphous solid comprises no calcium carbonate such as chalk.

In particular embodiments which include filler, the filler is fibrous. For example, the filler may be a fibrous organic filler material such as wood pulp, hemp fibre, cellulose or cellulose derivatives. Without wishing to be bound by theory, it is believed that including fibrous filler in an amorphous solid may increase the tensile strength of the material. This may be particularly advantageous in examples wherein the amorphous solid is provided as a sheet, such as when an amorphous solid sheet circumscribes a rod of aerosolizable material.

In some embodiments, the amorphous solid does not comprise tobacco fibres. In particular embodiments, the amorphous solid does not comprise fibrous material.

In some embodiments, the aerosol generating material does not comprise tobacco fibres. In particular embodiments, the aerosol generating material does not comprise fibrous material.

In some embodiments, the aerosol generating substrate does not comprise tobacco fibres. In particular embodiments, the aerosol generating substrate does not comprise fibrous material.

In some embodiments, the aerosol generating article does not comprise tobacco fibres. In particular embodiments, the aerosol generating article does not comprise fibrous material.

In some cases, the amorphous solid may consist essentially of, or consist of a gelling agent, a setting agent, an aerosol generating agent, an active substance, water, and optionally a flavor.

In some cases, the amorphous solid may consist essentially of, or consist of a gelling agent, a setting agent, an aerosol generating agent, a tobacco material or a nicotine source, water, and optionally a flavor.

In some examples, the amorphous solid in sheet form may have a tensile strength of from around 200 N/m to around 900 N/m. In some examples, such as where the amorphous solid does not comprise a filler, the amorphous solid may have a tensile strength of from 200 N/m to 400 N/m, or 200 N/m to 300 N/m, or about 250 N/m. Such tensile strengths may be particularly suitable for embodiments wherein the aerosol generating material may be formed as a sheet and then shredded and incorporated into an aerosol generating article. In some examples, such as where the amorphous solid comprises a filler, the amorphous solid may have a tensile strength of from 600 N/m to 900 N/m, or from 700 N/m to 900 N/m, or around 800 N/m. Such tensile strengths may be particularly suitable for embodiments wherein the aerosol generating material may be included in an aerosol generating article/assembly as a rolled sheet, suitably in the form of a tube.

The aerosol generating material comprising the amorphous solid may have any suitable area density, such as from 30 $g/m^2$ to 120 $g/m^2$. In some embodiments, aerosol generating material may have an area density of from about 30 to 70 $g/m^2$, or about 40 to 60 $g/m^2$. In some embodiments, the amorphous solid may have an area density of from about 80 to 120 $g/m^2$, or from about 70 to 110 $g/m^2$, or particularly from about 90 to 110 $g/m^2$. Such area densities may be particularly suitable where the aerosol-generating material may be included in an aerosol generating article/assembly in sheet form, or as a shredded sheet (described further hereinbelow).

In some cases, a gel pre-cursor slurry may first be applied to the surface. This may be applied by electrospraying or by any other technique known in the art. A setting agent may then be applied by electrospraying. Alternatively, the setting agent may be provided on or in the surface first, optionally by electrospraying, and then a gel pre-cursor slurry may be applied by electrospraying. For example, the surface may be pre-loaded with a setting agent (e.g. a calcium source) and a gel-precursor slurry (containing all other components of the aerosol-forming material, including alginate or pectin as a binder) may be sprayed onto the surface (resulting in gelation on contact of the calcium and alginate/pectin). In some cases, the materials are sprayed onto a carrier may comprise a reconstituted tobacco which contains calcium.

In yet further cases, separate components of the aerosol-forming material may be mixed in the electrospray plume so that gelation initiates between the electrospray nozzle and the surface.

In some examples, the slurry has a viscosity of from about 10 to about 20 Pa·s at 46.5° C., such as from about 14 to about 16 Pa·s at 46.5° C.

For example, the slurry may comprise sodium, potassium or ammonium alginate as a gel-precursor. The setting agent may comprise a calcium source (such as calcium chloride). The total amount of the setting agent, such as a calcium source, may be 0.5-5 wt % (calculated on a dry weight basis). The inventors have found that the addition of too little setting agent may result in a gel which does not stabilize the gel components and results in these components dropping out of the gel. The inventors have found that the addition of too much setting agent results in a gel that is very tacky and consequently has poor handleability.

Alginate salts are derivatives of alginic acid and are typically high molecular weight polymers (10-600 kDa). Alginic acid is a copolymer of β-D-mannuronic (M) and α-L-guluronic acid (G) units (blocks) linked together with (1,4)-glycosidic bonds to form a polysaccharide. On addition of calcium cations, the alginate crosslinks to form a gel. The inventors have determined that alginate salts with a high G monomer content more readily form a gel on addition of the calcium source. In some cases therefore, the gel-precursor pay comprise an alginate salt in which at least about 40%, 45%, 50%, 55%, 60% or 70% of the monomer units in the alginate copolymer are α-L-guluronic acid (G) units.

In some cases, the carrier of the aerosol-forming substrate may be substantially or wholly impermeable. This prevents aerosol or gas passage through the carrier, thereby controlling the flow of aerosol in use and ensuring it is delivered to the user. This can also be used to reduce or prevent condensation or other deposition of the gas/aerosol in use on, for example, the surface of a heater provided in an aerosol generating assembly. Thus, consumption efficiency and hygiene can be improved in some cases.

The carrier may be any suitable material which can be used to support an aerosol-forming material. In some cases, the carrier may be formed from materials selected from metal foil, paper, carbon paper, greaseproof paper, ceramic, carbon allotropes such as graphite and graphene, plastic, wood, cardboard or combinations thereof. In some cases, the carrier may comprise or consist of a tobacco material, such as a sheet of reconstituted tobacco. In some cases, the carrier may be formed from materials selected from metal foil, paper, cardboard, wood or combinations thereof. For example, the carrier may be formed from a laminate comprising layers of materials selected from the preceding lists. For example, the carrier may be a paper-backed foil. The foil may be substantially impermeable to gas/aerosol, providing control of flow path, and may also conduct heat to the aerosol-forming material.

Suitably, the thickness of the carrier layer may be in the range of about 10 μm, 15 μm, 17 μm, 20 μm, 23 μm, 25 μm, 50 μm, 75 μm or 0.1 mm to about 2.5 mm, 2.0 mm, 1.5 mm, 1.0 mm or 0.5 mm. The carrier may comprise more than one layer, and the thickness described herein refers to the aggregate thickness of those layers.

In some cases, the carrier may comprise or consist of a paper layer which abuts the aerosol-forming material; the inventors have found that aerosol-forming materials (such as gels) bind well to paper. Without being limited by theory, it is thought that the slurry from which the aerosol-forming material (e.g. gel) is formed partially impregnates the paper so that when the material solidifies/sets, the paper is partially bound into the material. This provides a strong binding between the material and the paper. The paper may have a porosity of 0-300 Coresta Units (CU), suitably 5-100 CU or 25-75 CU.

Additionally, surface roughness may contribute to the strength of bond between the amorphous material and the carrier. The inventors have found that the paper roughness (for the surface abutting the carrier) may suitably be in the range of 50-1000 Bekk seconds, suitably 50-150 Bekk seconds, suitably 100 Bekk seconds (measured over an air pressure interval of 50.66-48.00 kPa). (A Bekk smoothness tester is an instrument used to determine the smoothness of a paper surface, in which air at a specified pressure is leaked between a smooth glass surface and a paper sample, and the time (in seconds) for a fixed volume of air to seep between these surfaces is the "Bekk smoothness".)

Conversely, the surface of the carrier facing away from the amorphous solid may be arranged in contact with the heater, and a smoother surface may provide more efficient heat transfer. Thus, in some cases, the carrier may be disposed so as to have a rougher side abutting the amorphous material and a smoother side facing away from the amorphous material.

In one particular case, the carrier may be a paper-backed foil; the paper layer abuts the amorphous solid layer and the properties discussed in the previous paragraphs are afforded by this abutment. The foil backing is substantially impermeable, providing control of the aerosol flow path in use. A metal foil backing may also serve to conduct heat to the amorphous solid.

In another case, the foil layer of the paper-backed foil abuts the amorphous solid. The foil is substantially impermeable, thereby preventing water provided in the amorphous solid to be absorbed into the paper which could weaken its structural integrity.

In some cases, the carrier may be formed from or comprises metal foil, such as aluminium foil. A metallic carrier may allow for better conduction of thermal energy to the amorphous solid. Additionally, or alternatively, a metal foil may function as a susceptor in an induction heating system. In particular embodiments, the carrier comprises a metal foil layer and a support layer, such as cardboard. In these embodiments, the metal foil layer may have a thickness of less than 20 μm, such as from about 1 μm to about 10 μm, suitably about 5 μm.

The aerosol-forming substrate obtained by the method described herein may be configured for use in an assembly that heats the substrate to generate an aerosol, without burning. For example, the amorphous solid may be formed as a and incorporated into an aerosol generating article or assembly in sheet form. In some cases, the aerosol generating material may be included as a planar sheet, as a bunched or gathered sheet, as a crimped sheet, or as a rolled sheet (e.g., in the form of a tube). In some such cases, the amorphous solid of these embodiments may be included in an aerosol generating article/assembly as a sheet, such as a sheet circumscribing a rod of aerosolizable material (e.g. tobacco). In some other cases, the aerosol generating material may be formed as a sheet and then shredded and incorporated into the article. In some cases, the shredded sheet may be mixed with cut rag tobacco and incorporated into the article.

The aerosol-forming substrate may be configured such that, in use, an aerosol generating assembly can heat, without burning, the aerosolizable material to between 120° C. and 350° C. in use. In some cases, the heater may heat, without burning, the aerosolizable material to between 140° C. and 250° C. in use. In some cases in use, substantially all of the amorphous solid is less than about 4 mm, 3 mm, 2 mm or 1 mm from the heater. In some cases, the solid may be disposed between about 0.010 mm and 2.0 mm from the heater, suitably between about 0.02 mm and 1.0 mm, suitably 0.1 mm to 0.5 mm. These minimum distances may, in some cases, reflect the thickness of a carrier that supports the amorphous solid. In some cases, a surface of the amorphous solid may directly abut the heater.

Exemplary Embodiments of Amorphous Solid

In some embodiments, the amorphous solid comprises menthol.

Particular embodiments comprising a menthol-containing amorphous solid may be particularly suitable for including in an aerosol generating article/assembly as a shredded sheet. In these embodiments, the amorphous solid may have the following composition (DWB): gelling agent (preferably comprising alginate, more preferably comprising a combination of alginate and pectin) in an amount of from about 20 wt % to about 40 wt %, or about 25 wt % to 35 wt %; menthol in an amount of from about 35 wt % to about 60 wt %, or from about 40 wt % to 55 wt %; aerosol generating agent (preferably comprising glycerol) in an amount of from about 10 wt % to about 30 wt %, or from about 15 wt % to about 25 wt % (DWB).

In one embodiment, the amorphous solid comprises about 32-33 wt % of an alginate/pectin gelling agent blend; about 47-48 wt % menthol flavorant; and about 19-20 wt % glycerol aerosol generating agent (DWB).

As noted above, the amorphous solid of these embodiments may be included in an aerosol generating article/assembly as a shredded sheet. The shredded sheet may be provided in the article/assembly blended with cut tobacco. Alternatively, the amorphous solid may be provided as a non-shredded sheet. Suitably, the shredded or non-shredded sheet has a thickness of from about 0.015 mm to about 1 mm, preferably from about 0.02 mm to about 0.07 mm.

Particular embodiments of the menthol-containing amorphous solid may be particularly suitable for including in an aerosol generating article/assembly as a sheet, such as a sheet circumscribing a rod of aerosolizable material (e.g. tobacco). In these embodiments, the amorphous solid may have the following composition (DWB): gelling agent (preferably comprising alginate, more preferably comprising a combination of alginate and pectin) in an amount of from about 5 wt % to about 40 wt %, or about 10 wt % to 30 wt %; menthol in an amount of from about 10 wt % to about 50 wt %, or from about 15 wt % to 40 wt %; aerosol generating agent (preferably comprising glycerol) in an amount of from about 5 wt % to about 40 wt %, or from about 10 wt % to about 35 wt %; and optionally filler in an amount of up to 60 wt %—for example, in an amount of from 5 wt % to 20 wt %, or from about 40 wt % to 60 wt % (DWB).

In one of these embodiments, the amorphous solid comprises about 11 wt % of an alginate/pectin gelling agent blend, about 56 wt % woodpulp filler, about 18% menthol flavorant and about 15 wt % glycerol (DWB).

In another of these embodiments, the amorphous solid comprises about 22 wt % of an alginate/pectin gelling agent blend, about 12 wt % woodpulp filler, about 36% menthol flavorant and about 30 wt % glycerol (DWB).

As noted above, the amorphous solid of these embodiments may be included as a sheet. In one embodiment, the sheet may be provided on a carrier comprising paper. In one embodiment, the sheet may be provided on a carrier comprising metal foil, suitably aluminium metal foil. In this embodiment, the amorphous solid may abut the metal foil.

In one embodiment, the sheet forms part of a laminate material with a layer (preferably comprising paper) attached to a top and bottom surface of the sheet. Suitably, the sheet of amorphous solid has a thickness of from about 0.015 mm to about 1 mm.

In some embodiments, the amorphous solid comprises a flavorant which does not comprise menthol. In these embodiments, the amorphous solid may have the following composition (DWB): gelling agent (preferably comprising alginate) in an amount of from about 5 to about 40 wt %, or from about 10 wt % to about 35 wt %, or from about 20 wt % to about 35 wt %; flavorant in an amount of from about 0.1 wt % to about 40 wt %, of from about 1 wt % to about 30 wt %, or from about 1 wt % to about 20 wt %, or from about 5 wt % to about 20 wt %; aerosol generating agent (preferably comprising glycerol) in an amount of from 15 wt % to 75 wt %, or from about 30 wt % to about 70 wt %, or from about 50 wt % to about 65 wt %; and optionally filler (suitably woodpulp) in an amount of less than about 60 wt %, or about 20 wt %, or about 10 wt %, or about 5 wt % (preferably the amorphous solid does not comprise filler) (DWB).

In one of these embodiments, the amorphous solid comprises about 27 wt % alginate gelling agent, about 14 wt % flavorant and about 57 wt % glycerol aerosol generating agent (DWB).

In another of these embodiments, the amorphous solid comprises about 29 wt % alginate gelling agent, about 9 wt % flavorant and about 60 wt % glycerol (DWB).

The amorphous solid of these embodiments may be included in an aerosol generating article/assembly as a shredded sheet, optionally blended with cut tobacco. Alternatively, the amorphous solid of these embodiments may be included in an aerosol generating article/assembly as a sheet, such as a sheet circumscribing a rod of aerosolizable material (e.g. tobacco). Alternatively, the amorphous solid of these embodiments may be included in an aerosol generating article/assembly as a layer portion disposed on a carrier.

In some embodiments, the amorphous solid comprises tobacco extract. In these embodiments, the amorphous solid may have the following composition (DWB): gelling agent (preferably comprising alginate) in an amount of from about 5 wt % to about 40 wt %, or about 10 wt % to 30 wt %, or about 15 wt % to about 25 wt %; tobacco extract in an amount of from about 30 wt % to about 60 wt %, or from about 40 wt % to 55 wt %, or from about 45 wt % to about 50 wt %; aerosol generating agent (preferably comprising glycerol) in an amount of from about 10 wt % to about 50 wt %, or from about 20 wt % to about 40 wt %, or from about 25 wt % to about 35 wt % (DWB).

In one embodiment, the amorphous solid comprises about 20 wt % alginate gelling agent, about 48 wt % Virginia tobacco extract and about 32 wt % glycerol (DWB).

The amorphous solid of these embodiments may have any suitable water content. For example, the amorphous solid may have a water content of from about 5 wt % to about 15 wt %, or from about 7 wt % to about 13 wt %, or about 10 wt %.

The amorphous solid of these embodiments may be included in an aerosol generating article/assembly as a shredded sheet, optionally blended with cut tobacco. Alternatively, the amorphous solid of these embodiments may be included in an aerosol generating article/assembly as a sheet, such as a sheet circumscribing a rod of aerosolizable material (e.g. tobacco). Alternatively, the amorphous solid of these embodiments may be included in an aerosol generating article/assembly as a layer portion disposed on a carrier. Suitably, in any of these embodiments, the amorphous solid has a thickness of from about 50 μm to about 200 μm, or about 50 μm to about 100 μm, or about 60 μm to about 90 μm, suitably about 77 μm.

The slurry for forming this amorphous solid may also form part of the disclosure. In some cases, the slurry may have an elastic modulus of from about 5 to 1200 Pa (also referred to as storage modulus); in some cases, the slurry may have a viscous modulus of about 5 to 600 Pa (also referred to as loss modulus).

In another case, the foil layer of the paper-backed foil abuts the amorphous solid. The foil is substantially impermeable, thereby preventing water provided in the amorphous solid to be absorbed into the paper which could weaken its structural integrity.

In some cases, the carrier is formed from or comprises metal foil, such as aluminium foil. A metallic carrier may allow for better conduction of thermal energy to the amorphous solid. Additionally, or alternatively, a metal foil may function as a susceptor in an induction heating system. In particular embodiments, the carrier comprises a metal foil layer and a support layer, such as cardboard. In these embodiments, the metal foil layer may have a thickness of less than 20 μm, such as from about 1 μm to about 10 μm, suitably about 5 μm.

All percentages by weight described herein (denoted wt %) are calculated on a dry weight basis, unless explicitly stated otherwise. All weight ratios are also calculated on a dry weight basis. A weight quoted on a dry weight basis refers to the whole of the extract or slurry or material, other than the water, and may include components which by themselves are liquid at room temperature and pressure, such as glycerol. Conversely, a weight percentage quoted on a wet weight basis refers to all components, including water.

For the avoidance of doubt, where in this specification the term "comprises" is used in defining the various embodiments, embodiments are also disclosed in which the various embodiments or feature can be defined using the terms "consists essentially of" or "consists of" in place of "comprises". Reference to a material "comprising" certain features means that those features are included in, contained in, or held within the material.

The above embodiments are to be understood as illustrative examples. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the disclosure, which is defined in the accompanying claims.

The invention claimed is:

1. A method of making an aerosol-forming substrate;

the aerosol-forming substrate comprising an aerosol-forming material, the aerosol-forming material comprising an active substance and about 5 to about 60 wt % gelling agent;

the method comprising electrospraying the aerosol-forming material or component or precursor thereof to form a uniform layer;

wherein the aerosol-forming material comprises an amorphous solid comprising a fibrous organic filler material and the amorphous solid has a thickness of 0.015 mm to about 1.00 mm; and wherein the aperture in the or each nozzle of the electrospray apparatus is sized in the range of 0.1-1.0 mm.

2. A method according to claim 1, wherein the aerosol-forming substrate comprises a carrier on which the aerosol-forming material is provided, wherein the method comprises electrospraying the aerosol-forming material or component or precursor thereof onto the carrier.

3. A method according to claim 1, wherein the aerosol-forming material further comprises one or more of an aerosol generating agent, a binding agent and a flavorant.

4. A method according to claim 3, where the aerosol-forming material comprises an aerosol generating agent selected from polyols, glycerol derivatives, monohydric alcohols, high boiling point hydrocarbons, acids, and esters.

5. A method according to claim 3, where the aerosol-forming material comprises a binding agent selected from alginates, polysaccharides, and gums.

6. A method according to claim 3, where the aerosol-forming material comprises a flavorant, the flavorant comprising one or more mint-flavors, suitably a mint oil from any species of the genus *Mentha*.

7. A method according to claim 1, wherein the surface onto which the aerosol-forming material or component or precursor thereof is electrosprayed is electrostatically charged during the electrospraying process.

8. A method according to claim 1, wherein the surface onto which the aerosol-forming material or component or precursor thereof is electrosprayed is heated during the electrospraying process.

9. A method according to claim 2, wherein the carrier is substantially impermeable to gas or aerosol.

10. A method according to claim 2, wherein the carrier comprises paper and the aerosol-forming material or precursor thereof is sprayed onto the paper.

11. An aerosol-forming substrate formed by the method of claim 1.

12. The method of claim 1, wherein the aerosol-forming material comprises about 15 to about 60 wt % gelling agent.

13. A method according to claim 1, wherein the electrospraying results in a homogenous material of even thickness.

14. A method according to claim 1, wherein the aerosol-forming material consists essentially of (i) a gelling agent, a setting agent, an aerosol generating agent, an active substance, water, and optionally a flavour, or (ii) a gelling agent, a setting agent, an aerosol generating agent, a tobacco material and/or a nicotine source, water, and optionally a flavour.

* * * * *